US008113922B2

(12) United States Patent
Esenwein

(10) Patent No.: US 8,113,922 B2
(45) Date of Patent: Feb. 14, 2012

(54) MACHINE TOOL, IN PARTICULAR HAND-HELD POWER TOOL

(75) Inventor: Florian Esenwein, Uhingen-Holzhausen (DE)

(73) Assignee: Robert Bosch GmbH, Stuttgart (DE)

( * ) Notice: Subject to any disclaimer, the term of this patent is extended or adjusted under 35 U.S.C. 154(b) by 535 days.

(21) Appl. No.: 12/307,649

(22) PCT Filed: Feb. 12, 2008

(86) PCT No.: PCT/EP2008/051649

§ 371 (c)(1), (2), (4) Date: Jan. 6, 2009

(87) PCT Pub. No.: WO2008/125368

PCT Pub. Date: Oct. 23, 2008

(65) Prior Publication Data

US 2009/0280732 A1 Nov. 12, 2009

(30) Foreign Application Priority Data

Apr. 12, 2007 (DE) ..... 10 2007 017 243

(51) Int. Cl.
*B24B 23/00* (2006.01)

(52) U.S. Cl. ..... 451/359; 451/449; 451/488; 310/47

(58) Field of Classification Search ..... 451/359, 451/449, 488, 294, 295, 452, 454, 455; 310/47, 310/50, 58, 59; 417/423.14
See application file for complete search history.

(56) References Cited

U.S. PATENT DOCUMENTS

| | | | | |
|---|---|---|---|---|
| 3,829,721 | A * | 8/1974 | Rosenthal, Jr. | 310/47 |
| 4,905,772 | A * | 3/1990 | Honsa et al. | 173/162.1 |
| 5,311,089 | A * | 5/1994 | Stroetgen et al. | 310/50 |
| 5,315,193 | A * | 5/1994 | Kummer et al. | 310/50 |
| 6,543,549 | B1 * | 4/2003 | Riedl et al. | 173/216 |
| 6,602,122 | B1 * | 8/2003 | Rudolf et al. | 451/344 |
| 7,166,939 | B2 * | 1/2007 | Voigt et al. | 310/47 |
| 7,217,178 | B2 * | 5/2007 | Oki et al. | 451/359 |
| 7,770,660 | B2 * | 8/2010 | Schroeder et al. | 173/217 |
| 2005/0225183 | A1 | 10/2005 | Braun et al. | |
| 2008/0090504 | A1 * | 4/2008 | Trautner et al. | 451/359 |

FOREIGN PATENT DOCUMENTS

| | | |
|---|---|---|
| DE | 29 10 845 | 10/1980 |
| DE | 295 01 974 | 6/1996 |
| DE | 295 13 331 | 12/1996 |
| DE | 102 48 921 | 5/2004 |
| EP | 1 911 547 | 4/2008 |
| GB | 2 297 871 | 8/1996 |

* cited by examiner

*Primary Examiner* — George Nguyen
(74) *Attorney, Agent, or Firm* — Michael J. Striker

(57) ABSTRACT

The invention relates to a machine tool, particularly a hand machine tool, which comprises a driving motor and an air guide element, which is disposed in the housing of the machine tool and conducts an air current passing over the driving motor to the outside. The air guide element comprises a functional section, which forms a part of the outer lateral surface of the machine tool.

11 Claims, 8 Drawing Sheets

MACHINE TOOL, IN PARTICULAR HAND-HELD POWER TOOL

Figure 1:
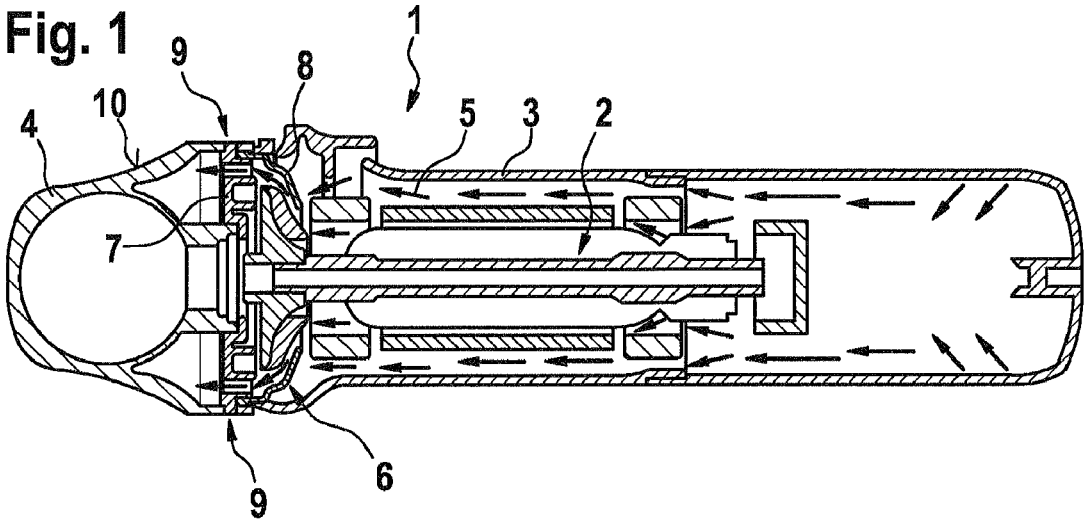

The present invention relates to a machine tool, in particular a hand-held power tool such as an angle grinder, having a drive motor which drives a tool, according to the preamble of claim 1.

BACKGROUND INFORMATION

DE 295 13 331 U1 describes a hand-guided angle grinder which includes an electric drive motor in a motor housing, the rotational motion of the rotor being transferred to the sanding disk of the angle grinder via a transmission which is located in a transmission housing. The motor housing and transmission housing are detachably secured to one another, in particular being inserted into one another.

To improve cooling, hand-held power tools of this type may be provided with an air guide element in the housing, which directs an airstream which passes over and cools the drive motor out of the housing.

DISCLOSURE OF THE INVENTION

The present invention is based on the object of improving a machine tool, in particular a hand-held power tool, which includes an air guide element in the housing, the improvement being realized using simple design measures and ensuring that the air guide element may perform functions in addition to the air guide function.

This object is achieved according to the present invention with the features of claim 1. The dependent claims describe expedient developments.

The machine tool according to the present invention—which is a hand-held power tool in particular, e.g. an angle grinder—includes a drive motor which drives a tool, and an air guide element which is located in the housing of the machine tool and directs an airstream which passes over the drive motor to the outside. It is also provided that the air guide element includes a functional section which is part of the outer jacket surface of the machine tool. The air guide element is therefore not integrated fully in the housing interior. Instead, the functional section of the air guide element extends through the housing. In this region, therefore, the jacket surface of the machine tool is formed by the outwardly projecting outer side of the functional section. It is therefore possible to assign various additional functions to the functional section; this may be realized using minimal structural expenditure. The functional section is advantageously designed as one piece with the air guide element which is preferably designed as a plastic part, in particular as an injection-molded part. Embodiments using another material for the air guide element are also feasible, e.g. metal embodiments.

The additional function to be performed by the functional section is basically independent of the air guide function of the air guide element. For example, the functional section may perform a damping function, in particular when a two-pieced housing is used, preferably in an embodiment of a machine tool having a motor housing and a transmission housing. In this case, the functional section of the air guide element may assume an intermediate position between the motor housing and the transmission housing, thereby effectively damping vibrations that originate from the motor, the transmission, or the tool, and are introduced into the housing. In the case of an annular design of the functional section in particular, the damping effect may be designed to be so effective that additional, separate damping elements between the transmission housing and the motor housing may be eliminated.

In the two-pieced design of the housing having an intermediate air guide element and functional section, it may be expedient to ensure that the housing parts may rotate relative to one another.

According to an advantageous embodiment, the functional section may extend through a recess in the housing just so far that a continuous jacket surface or raised area or recess is formed. As an alternative, it is also possible, however, for the functional section to be raised above the enclosing jacket surface in the manner of a relief, or to remain below it in a recess. In the case of a raised design of the functional section in particular, it may perform a large number of different tasks. One example is the function of protecting further components which extend away from the housing, e.g. an on/off switch, in order to ensure that components of this type which break relatively easily are protected by the functional section of the air guide element if the hand-held power tool is accidentally dropped, the air guide element being situated in particular on the housing in front of the element to be protected, and/or extending further outwardly than the element to be protected. A projecting functional section also has the advantage that slip protection may be realized, which prevents the operator's hand from accidentally slipping in the direction of the tool of the machine tool.

It is also possible to situate several functional sections around the circumference of the housing, each functional section extending through a recess in the housing. This ensures that the particular function to be performed by the functional section is effective around the circumference of the device. In addition, various functional sections may perform various tasks.

According to a further advantageous embodiment, the functional section is designed as a rotation lock element between the housing parts of the machine tool. Using the rotation lock element, it is possible to establish a form-fit connection between the housing parts, which acts in the circumferential direction in particular, and may also act in the axial direction, and which securely locks the housing parts relative to each other. The form-fit connection may be created between only one housing part and the functional section, or between both housing parts and the functional section. The functional section may also be used as a joining aid during assembly.

According to a further advantageous embodiment, the air guide element has a several-pieced design and includes, in particular, an air guide ring and an air guide disk, the components of the air guide element interacting with one another and, in particular, touching one another, and the functional section being located on one of the components, but possibly also on several or all components of the air guide element.

Further advantages and advantageous embodiments are depicted in the further claims, the description of the figures, and the drawings.

Figure 2:
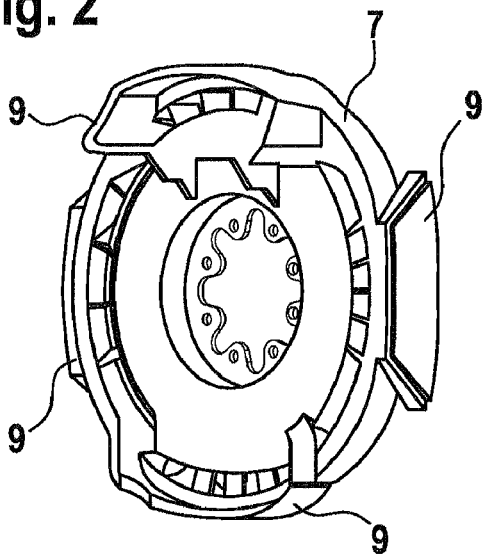
Figure 3:
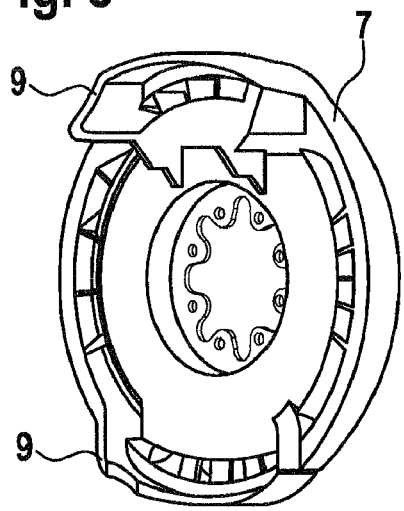
Figure 4:
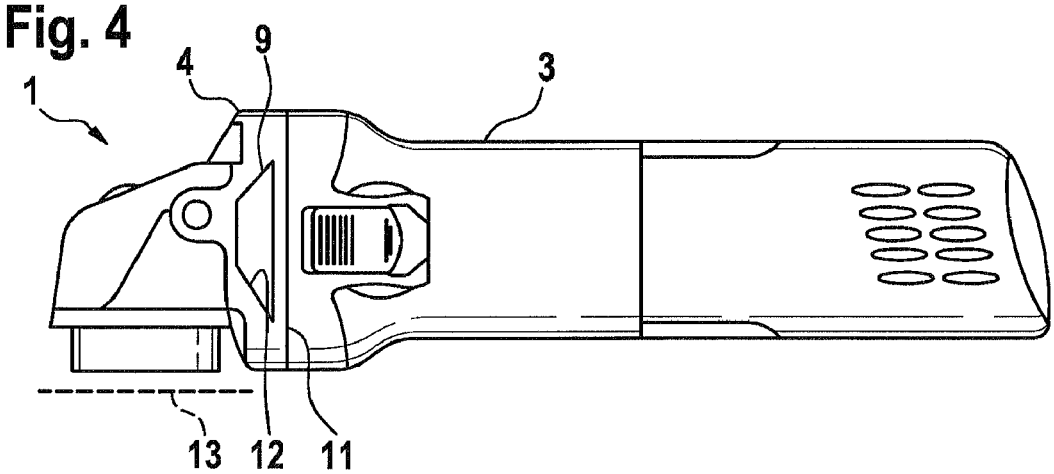
Figure 5:
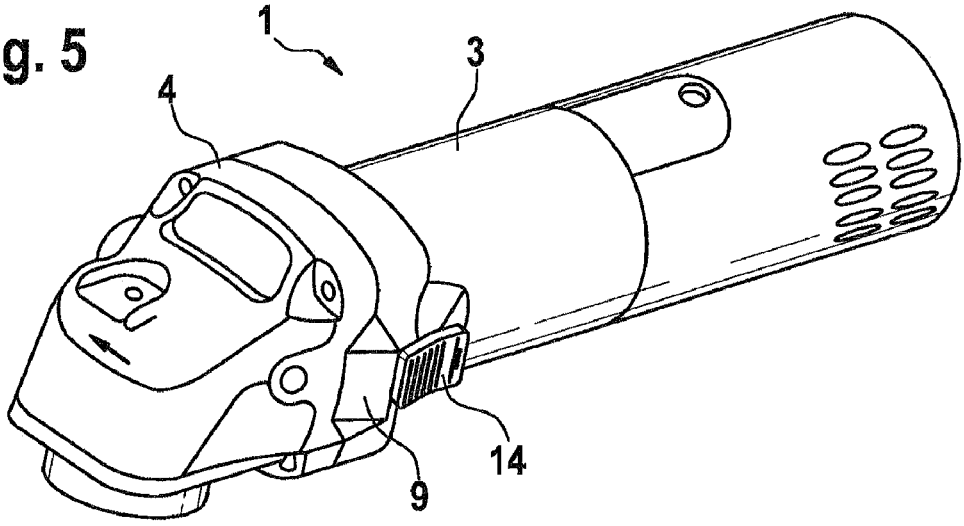
Figure 6:
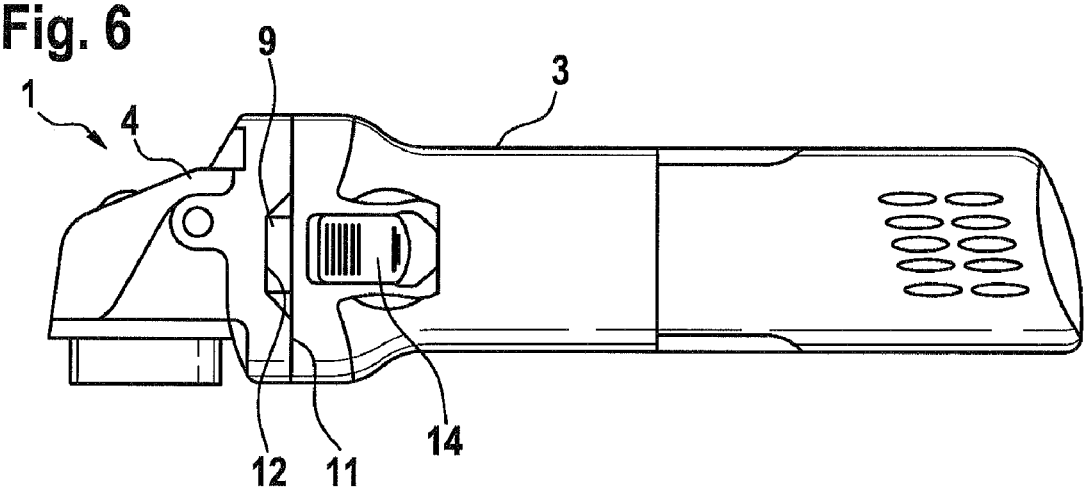
Figure 7:
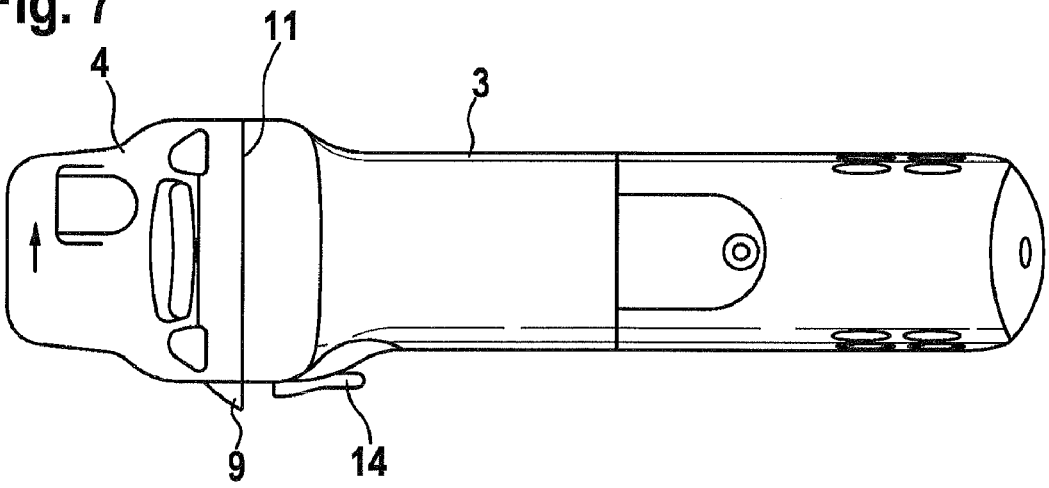
Figure 10:
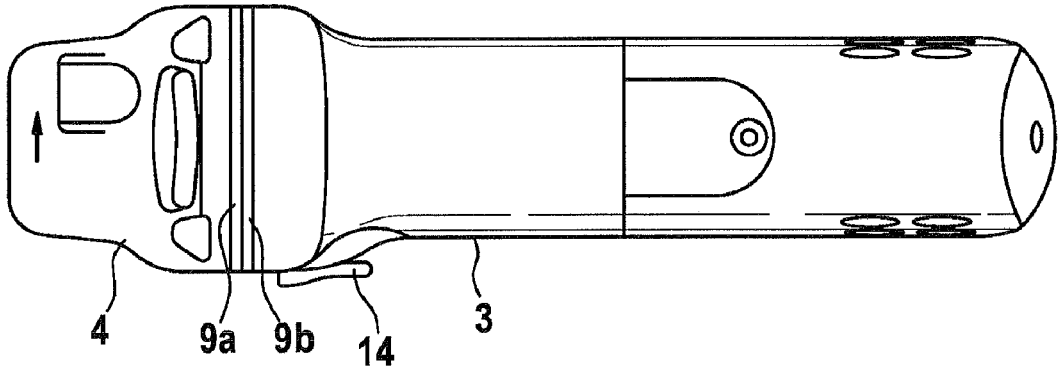
Figure 11:
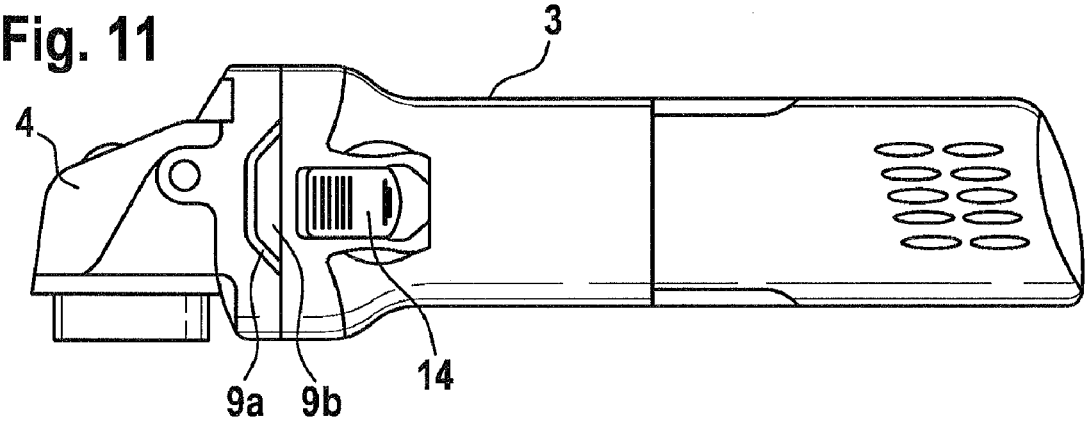
Figure 12:
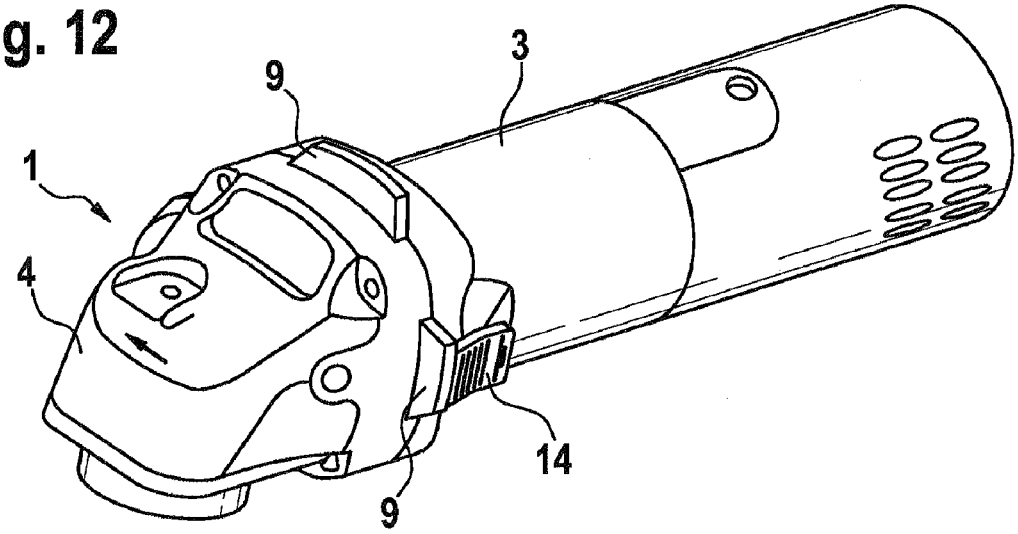
Figure 13:
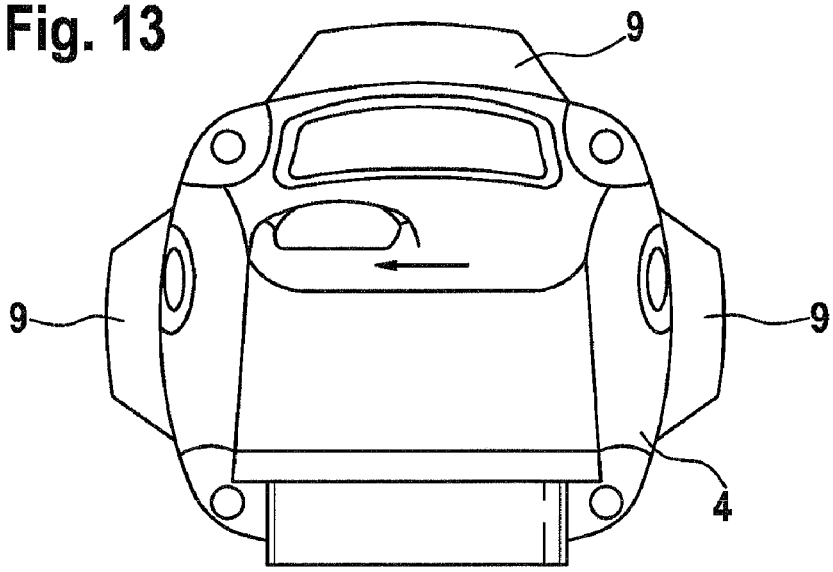
Figure 14:
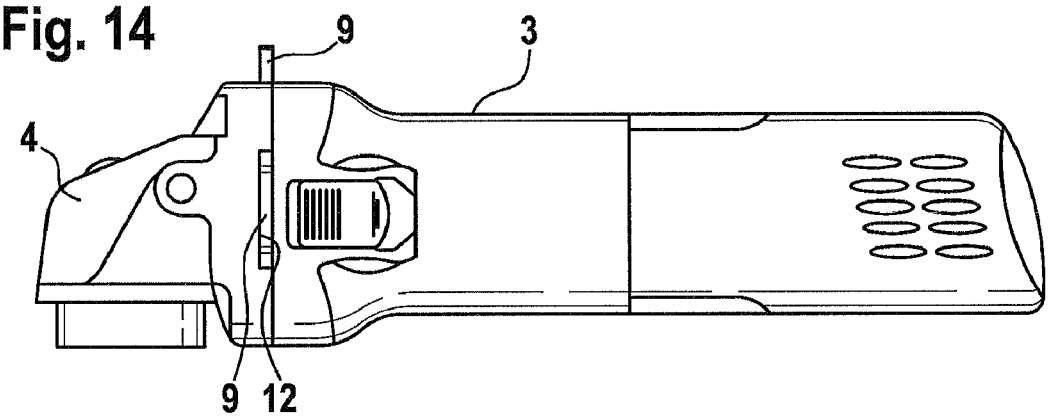
Figure 15:
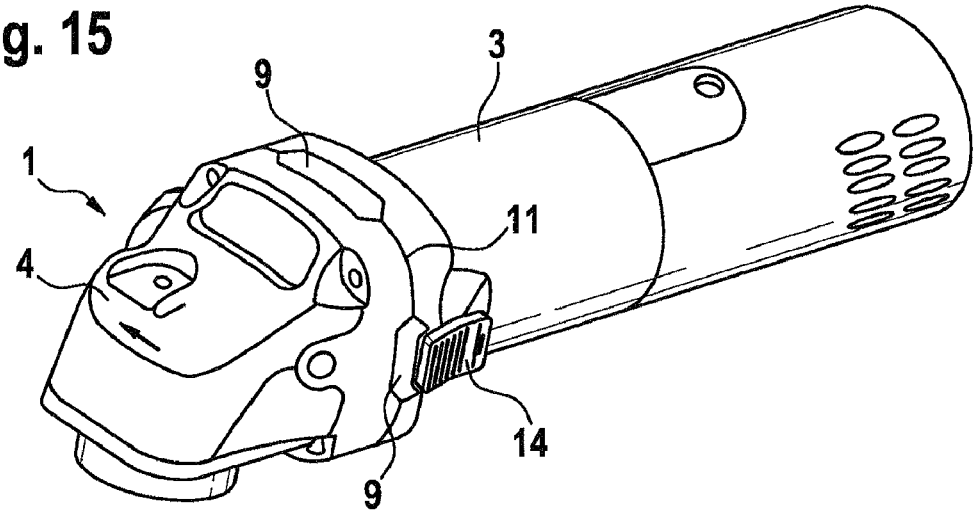
Figure 16:
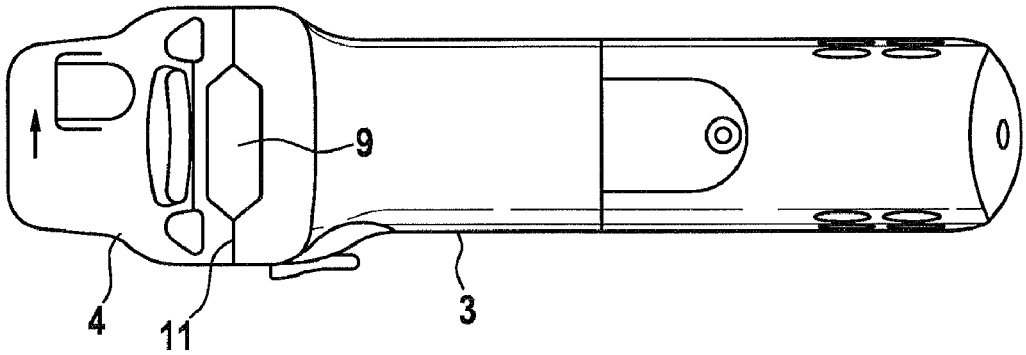
Figure 17:
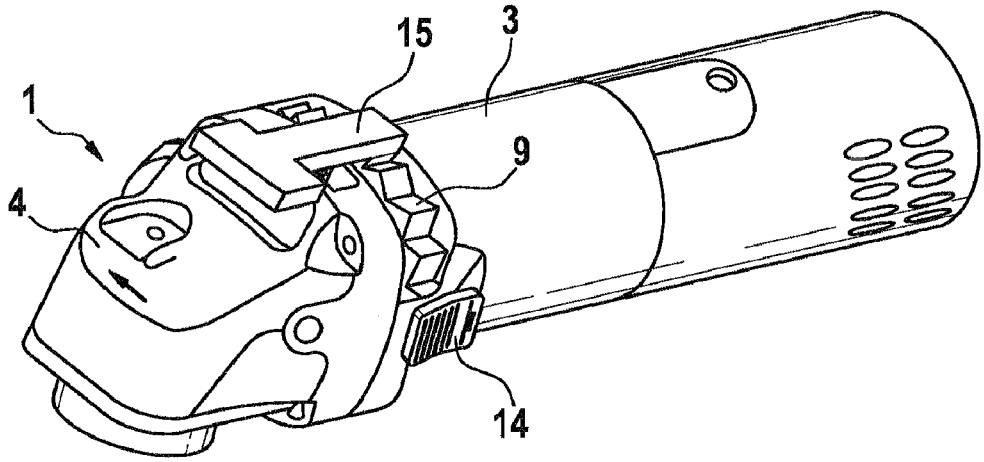
Figure 18:
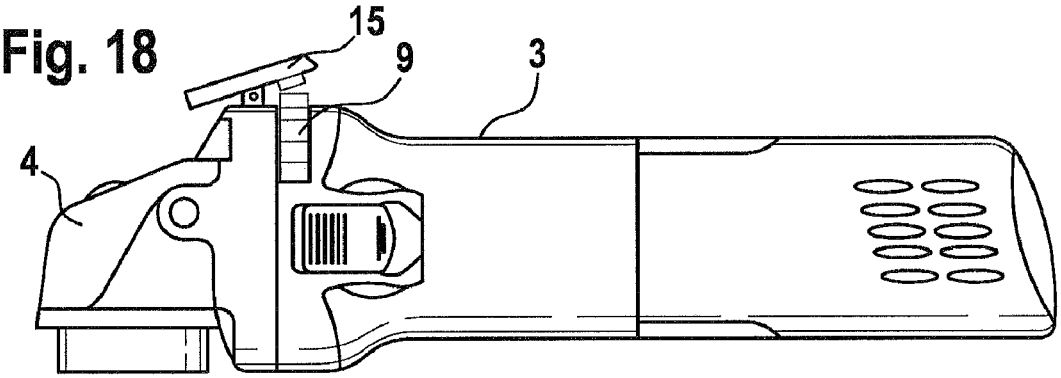
Figure 19:
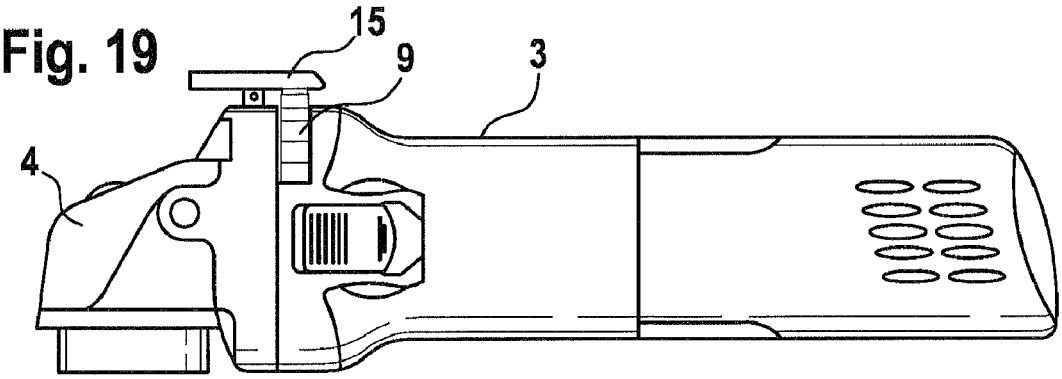
Figure 20:
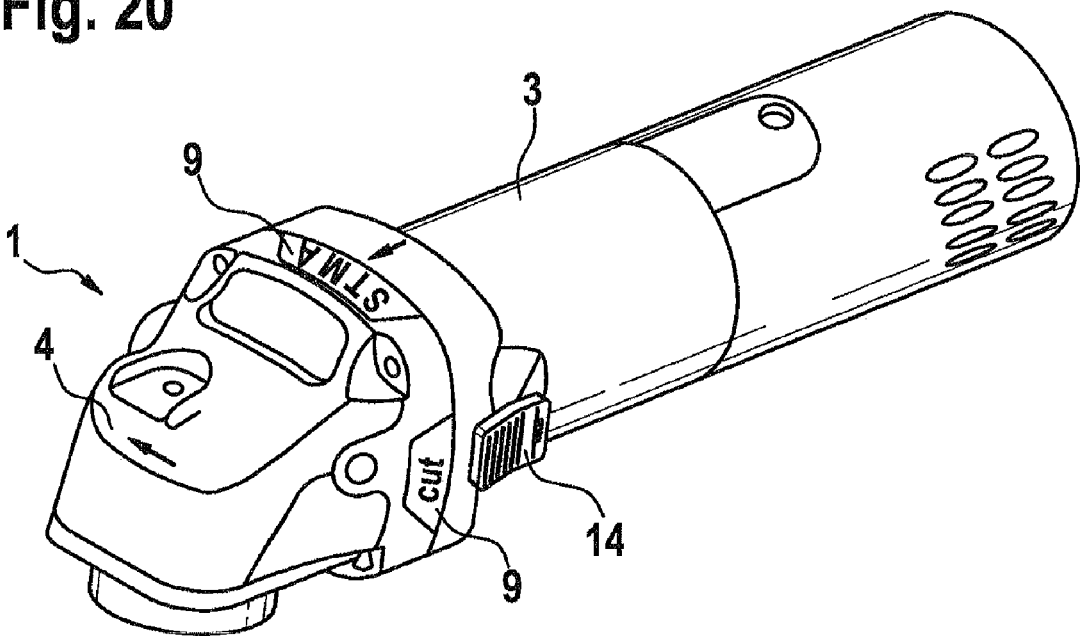
Figure 21:
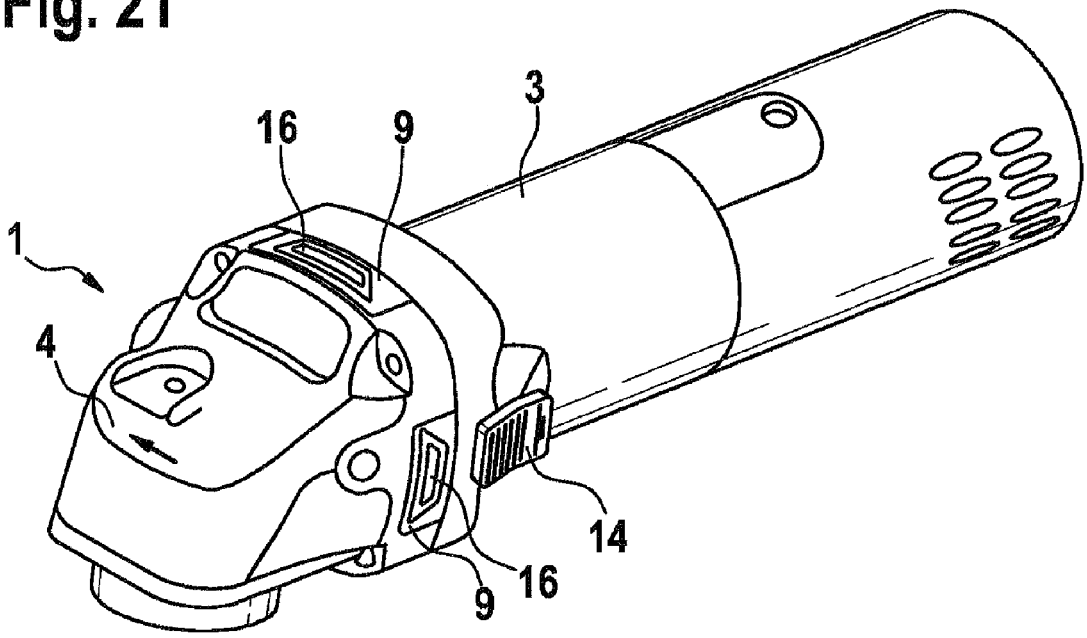
Figure 22:
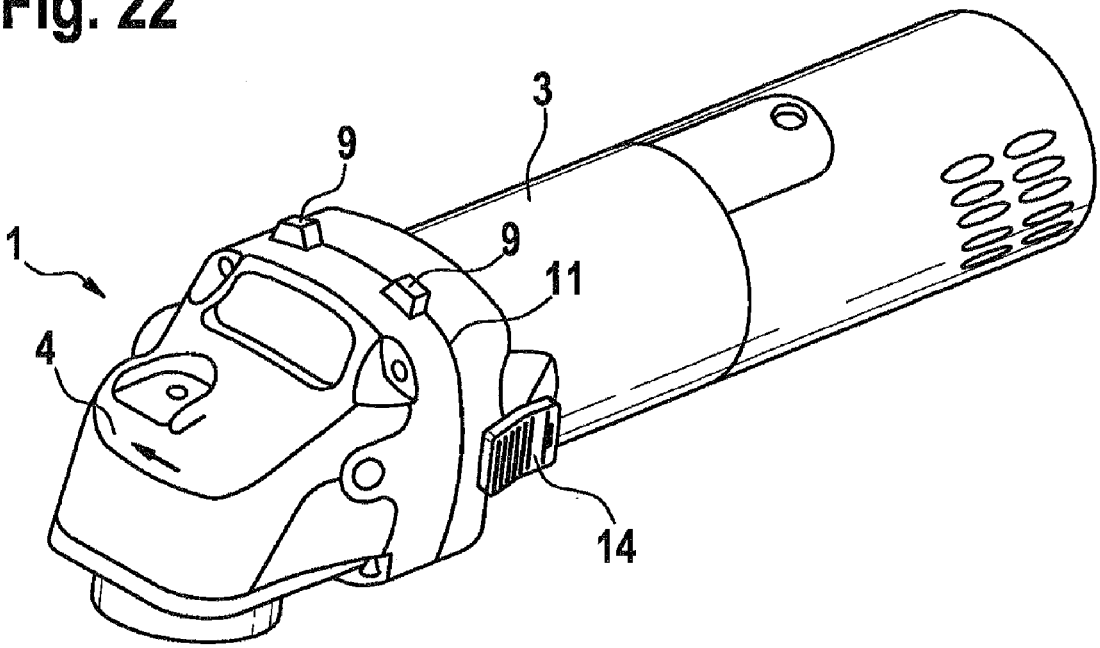
Figure 23:
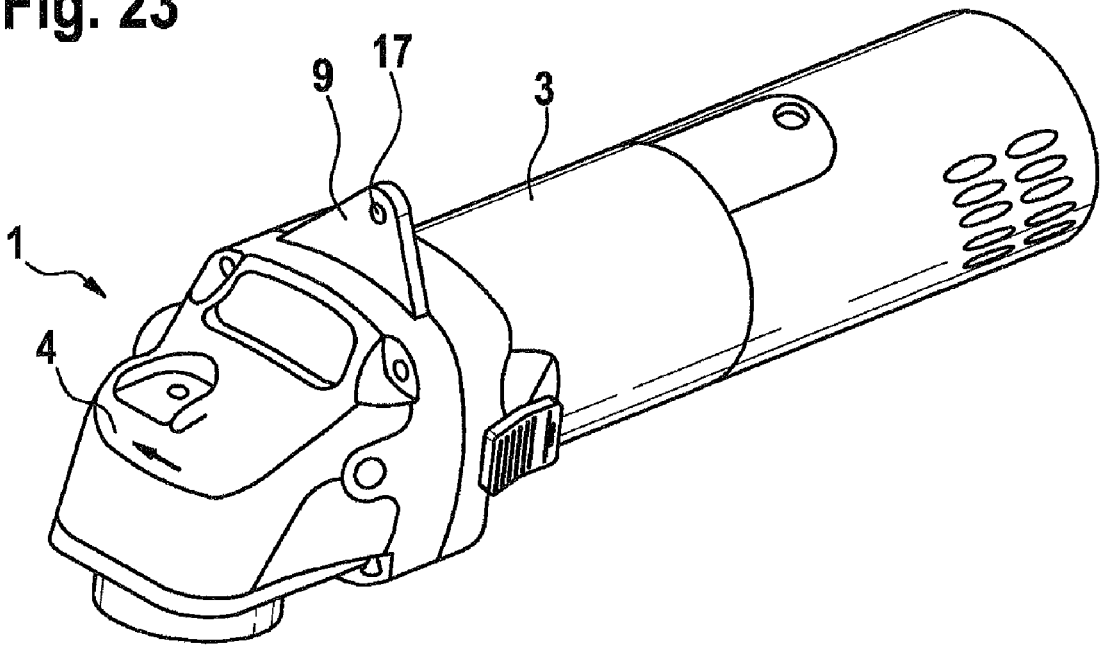

FIG. 1 shows a sectional view through an angle grinder which includes a motor housing and a transmission housing, and a two-pieced air guide element which is located in the transition region of the housing parts and is composed of an air guide ring and an air guide disk; functional sections are located on the air guide disk, which extend through recesses in the wall of the transmission housing, thereby forming a part of the outer jacket surface of the housing, FIG. 2 shows a perspective, single view of an air guide disk with a total of four functional sections which are distributed around the circumference, FIG. 3 shows a perspective, single view of an air guide disk having only two functional sections, on opposite sides of the circumference, FIG. 4 shows a side view of an angle grinder with a functional section of an air guide element which extends through a recess in the transmission housing, FIGS. 5 through 7 show various views of an angle grinder with a single functional section—which extends laterally away from the transmission housing—of an air guide element which serves to protect an on/off switch of the machine tool, FIGS. 8 through 11 show a further embodiment of an angle grinder with a design of the functional section of the air guide element as a damping element which is located between the motor housing and the transmission housing, FIGS. 12 through 14 show a further embodiment, in the case of which three functional sections are located on the air guide element and extend away from the housing, thereby providing slip protection, FIGS. 15 and 16 show a further embodiment, in the case of which the functional section of the air guide element serves as a rotation lock, FIGS. 17 through 19 show a further embodiment, in the case of which the functional element also serves as a rotation lock but interacts with an adjustable lever, FIG. 20 shows a further embodiment, in the case of which various functional sections of the air guide element serve as a pictogram in order to inform the user about various tasks of the machine tool when the transmission housing is in various angular positions relative to the motor housing, FIG. 21 shows a further embodiment, in the case of which the functional sections serve as an additional air outlet, FIG. 22 shows a further embodiment, in the case of which two functional sections located at the top serve as spacers or pins to ensure that the angle grinder is secure when placed on its back, FIG. 23 shows a further embodiment, in the case of which a single functional section on the top side of the housing is provided with an eyelet which may be used, e.g., to set the tool down or to safeguard it.

Components that are the same are labelled with the same reference numerals in the figures.

Hand-held power tool 1 shown in FIG. 1 is an angle grinder which includes an electric drive motor 2 in a motor housing 3 which is connected to a transmission housing 4. A transmission (not depicted) is situated in transmission housing 4. The transmission is driven by the rotor of the electric drive motor and transfers the rotational motion of the rotor to a rotating tool. To cool motor 2, an airstream 5 is created in the interior of motor housing 3, which is guided past the drive motor and is directed via an air guide element 6 out of the housing. Air guide element 6 has a two-pieced design and includes an air guide disk 7 and an air guide ring 8. Air guide disk 7 and air guide ring 8 are located in the transition region between motor housing 3 and transmission housing 4, air guide disk 7 being connected to transmission housing 4, and air guide ring 8 being connected to motor housing 3. In the installed position, air guide element 6 and air guide disk 7 interact with one another, and the two components touch one another. A flow path for diverting airstream 5 is formed between the components.

One-pieced functional sections 9 are provided on air guide disk 7 in transmission housing 4 and extend into a recess in the wall of transmission housing 4. Functional sections 9 may perform tasks in addition to the air guide function. These additional tasks will be described below with reference to the further figures. The outwardly facing side of functional sections 9 form one part of outer jacket surface 10 of the machine tool. It is possible for the closure with the surrounding jacket surface regions to be flush and/or flat. It is also possible for functional sections 9 to be raised in design, or for them to be offset into the recess in the housing, so that the jacket surface is recessed in this region.

As shown in the perspective illustrations of an air guide disk 7 in FIGS. 2 and 3, a plurality of individual functional sections 9 which are distributed around the circumference may be designed as a single piece with air guide disk 7. Since functional sections 9 extend into recesses in the housing, functional sections 9 are situated radially further away from the center axis than are the remaining regions of the air guide disk.

As shown in the side view in FIG. 4, functional section 9 is positioned adjacent to parting line 11 between motor housing 3 and transmission housing 4. A recess 12 is formed in transmission housing 4. The shape of recess 12 and the shape of functional section 9 are matched to one another, so that the functional section fills recess 12 completely. Recess 12 is situated only a small distance away from parting line 11 between motor housing 3 and transmission housing 4.

In addition, the rotating tool is shown on the underside of the transmission housing, labeled with reference numeral 13.

In the embodiment shown in FIG. 4, functional section 9 performs a design function, and possibly also an indicating function, e.g. information may be printed on the surface of the functional section.

In the embodiment shown in FIGS. 5 through 7, functional section 9 of the air guide element serves as protection for on/off switch 14, via which the hand-held power tool is switched on and off. A single functional section 9 is provided for this purpose. Functional section 9 extends laterally away from transmission housing 4 and extends further away from the housing, in the transverse direction in particular, than does on/off switch 14 which is located on the same side. Recess 12 in transmission housing 4 in which functional section 9 is inserted extends to parting line 11 between transmission housing 4 and motor housing 3.

Functional section 9 is designed as one piece with the air guide element and is composed, in particular, of the same material as the air guide element. A composite design is also possible, in the case of which the functional section is made of another material than are the other parts of the air guide element. For example, the functional section may be made of a softer material when it is used for switch protection, e.g. it may be made of rubber or a rubber-like material, in order to buffer the impact if the hand-held power tool is dropped.

Figure 8:
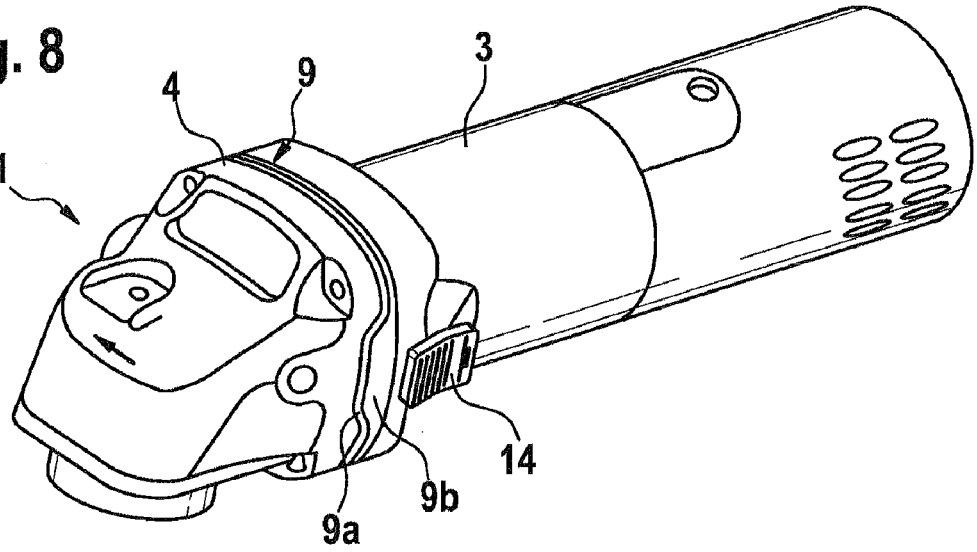
Figure 9:
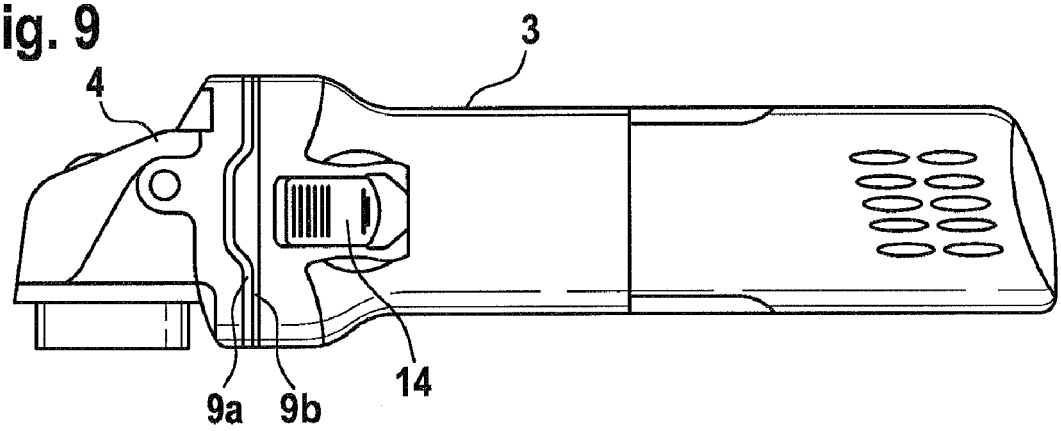

FIGS. 8 through 11 show the functional element as a damping element which is located between the motor housing and the transmission housing and is designed to dampen vibrations in the housing. FIGS. 8 and 9 show a first variant of the embodiment. Further variants are shown in FIGS. 10 and 11. In all of the variants, the functional section has a two-component design, having a first part 9*a* and a second part 9*b*.

According to FIGS. 8 and 9, both functional sections 9*a*, 9*b* are annular in design and extend around the entire circumference of the angle grinder in the transition region between motor housing 3 and transmission housing 4. In the lateral region, adjacent to on/off switch 14, there is an axial expansion in functional section 9*b*, which is compensated for by a corresponding shape of the other functional section 9*a*. Functional section 9*a* has a constant thickness around its circumference. Functional section 9*a* is located on transmission housing 4, and opposite functional section 9*b* is located on motor housing 3. Every functional section belongs to one air guide element or one part of an air guide element.

In the variant of the embodiment shown in FIG. 10, functional sections 9*a* and 9*b* have identical designs and have a constant thickness in the circumferential direction.

In the variant of the embodiment shown in FIG. 11, functional sections 9*a* and 9*b* do not extend around the entire circumference. Instead, they are located in the side region of the hand-held power tool adjacent to on/off switch 14. Functional sections 9*a*, 9*b* are located in a recess formed in transmission housing 4.

In the embodiment shown in FIGS. 12 through 14, functional section 9 serves as slip protection, to prevent the operator's hand from accidentally slipping on the grip of the hand-held power tool and sliding in the direction of the rotating tool. Three functional sections 9 which are distributed around the circumference are provided on the top side and in the two side regions. Functional sections 9 have a trapezoidal cross section and are raised above the jacket surface of transmission housing 4. As shown in FIG. 14, functional sections 9 are located on the side of transmission housing 4 and extend through a recess 12 formed in transmission housing 4.

In FIGS. 15 and 16, functional section 9 serves as a rotation lock element which serves to prevent motor housing 3 and transmission housing 4 from rotating relative to one another. For this purpose, a recess is formed in the housing wall of both housing parts in the region of parting line 11 between motor housing 3 and transmission housing 4, in which functional section 9 is situated. Functional section 9 therefore extends partially into the region of motor housing 3 and partially into the region of transmission housing 4. As a result, the two housing parts are unable to rotate relative to each other.

A further example of a rotation lock is shown in FIGS. 17 through 19. Functional section 9 is inserted in a recess in motor housing 3 and includes, on its outer side, toothing which interacts with a lever 15 which is located on the top side of transmission housing 4. Lever 15 may be moved between the disengaged position shown in FIG. 18 and the engaged position shown in FIG. 19, in which lever 15 engages in a latching manner with the toothing on the outer side of functional section 9. In this manner as well, the two housing parts 3 and 4 may be prevented from rotating relative to each other. An additional axial latching engagement may also be realized, thereby also preventing housing parts 3 and 4 from becoming detached from one another in the axial direction.

In the embodiment shown in FIG. 2, various functional sections 9 are distributed around the circumference in the region of transmission housing 4. Functional sections 9 serve as a pictogram which is used to indicate various functions of the angle grinder at various relative angular positions between motor housing 3 and transmission housing 4. For example, a different angular position may be better suited when the device is used as a grinding device than when it is used as a cutting device.

In the embodiment shown in FIG. 21, functional sections 9 serve as air outlets via which the airstream is guided out of the interior of the housing. For this purpose, functional sections 9 are each provided with openings 16 which are connected to the interior of the housing, thereby creating a continuous flow path for the airstream from the housing interior into the atmosphere. The airstream may be guided through the air outlets in a manner such that the exhaust air does not flow in the direction of the user, but rather, e.g. toward the front, in the direction of the tool.

In the embodiment shown in FIG. 22, functional sections 9 serve as support elements which are raised above the jacket surface of transmission housing 4 on its top side, thereby making it possible to set the hand-held power tool down on its back.

In the embodiment shown in FIG. 23, a single functional section 9 is provided on the top side of transmission housing 4. Functional section 9 has an approximately triangular cross section, and an eyelet 17 is formed in the functional section. Eyelet 17 makes it possible to hang the hand-held power tool on a hook or the like, or to safeguard it with the aid of a shackle lock.

What is claimed is:

1. A machine tool, in particular a hand-held power tool such as an angle grinder (1) having a drive motor (2) which drives a tool (13), and an air guide element (6) which is located in a housing of the machine tool (1), includes an air guide ring (8) and an air guide disk (7) and directs an airstream which passes over the drive motor (2) to the outside, wherein the air guide element (6) further includes a functional section (9) which forms a part of an outer jacket surface (10) of the machine tool, wherein the housing is divided into two parts and the functional section (9) of the air guide element (6) is located between the two housing parts or adjacent to a parting line (11) between the two housing parts and, wherein the air guide ring (8) is located in the first housing part (3) and the air guide disk (7) is located in the second housing part (4).

2. The machine tool as recited in claim 1, wherein the functional section (9) extends through a recess (12) in the housing.

3. The machine tool as recited in claim 1, wherein the functional section (9) is integrated in the jacket surface (12) of the housing.

4. The machine tool as recited in claim 1, wherein the functional section (9) extends beyond the jacket surface (12) of the housing.

5. The machine tool as recited in claim 1, wherein the air guide ring (8) touches the air guide disk (7).

6. The machine tool as recited in claim 1, wherein several functional sections (9) are provided which are distributed around the circumference and extend into the jacket surface (10) or form the jacket surface (10).

7. The machine tool as recited in claim 1, wherein the first housing part (3) comprises a motor housing (3) in which the drive motor (2) is located, and the second housing part (4) comprises a transmission housing (4) in which a transmission is located.

8. The machine tool as recited in claim 1, wherein the functional section (9) is designed as a rotation lock element which is located between the first and second housing parts (3, 4).

9. The machine tool as recited in claim 1, wherein the functional section (9) is designed as a damping element and, in particular, is annular in design.

10. The machine tool as recited in claim 1, wherein the functional section (9) is designed as an air outlet element and includes an opening (16).

11. A hand-held machine tool such as an angle grinder (1) having a drive motor (2) which drives a tool (13), and an air guide element (6) which is located in the housing of the machine tool (1) and directs an airstream which passes over the drive motor (2) to the outside, wherein the air guide element (6) includes a functional section (9) which forms a part of an outer jacket surface (10) of the machine tool, includes an air guide ring (8) and an air guide disk (7) and wherein the air guide ring (8) touches the air guide disk (7).

* * * * *